United States Patent [19]

Veyhl et al.

[11] Patent Number: 4,679,510

[45] Date of Patent: Jul. 14, 1987

[54] OFFICE DESK, IN PARTICULAR FOR PERIPHERAL COMPUTER EQUIPMENT

[75] Inventors: Wolf Veyhl; Erwin Kübler, both of Neuweiler, Fed. Rep. of Germany

[73] Assignee: Veyhl Produktion KG, Fed. Rep. of Germany

[21] Appl. No.: 738,050

[22] Filed: May 24, 1985

[30] Foreign Application Priority Data

Jun. 2, 1984 [DE] Fed. Rep. of Germany ..... 3420648

[51] Int. Cl.[4] ..... B60C 17/00

[52] U.S. Cl. ..... 108/152; 108/64; 108/111; 108/109

[58] Field of Search ..... 108/111, 109, 114, 108, 108/106, 64; 211/189, 186, 187, 192; 312/195, 273

[56] References Cited

U.S. PATENT DOCUMENTS

| | | | |
|---|---|---|---|
| 3,517,623 | 6/1970 | Goldstein et al. | 108/114 |
| 3,655,159 | 4/1972 | Held, Jr. | 108/114 X |
| 3,680,711 | 8/1972 | Brucker | 211/192 X |
| 3,693,556 | 9/1972 | Rous | 108/109 |
| 3,807,320 | 4/1974 | Textoris | 211/187 X |
| 3,810,430 | 5/1974 | Siegal | 108/109 X |
| 3,964,401 | 6/1976 | Gutmann, Jr. | 108/64 |
| 4,049,331 | 9/1977 | Gutmann, Jr. | 108/64 X |
| 4,117,825 | 10/1978 | Robertson | 108/152 X |
| 4,197,950 | 4/1980 | Ovitz, III | 211/187 X |
| 4,501,369 | 2/1985 | Fox | 108/111 X |

FOREIGN PATENT DOCUMENTS

| | | | |
|---|---|---|---|
| 193571 | 2/1957 | Austria | 108/109 |
| 3207177 | 2/1984 | Fed. Rep. of Germany . | |
| 921003 | 3/1963 | United Kingdom | 211/192 |

*Primary Examiner*—Peter A. Aschenbrenner

[57] ABSTRACT

An office desk suited in particular for peripheral computer equipment consists of two side parts formed by columns provided with feet, a longitudinal beam detachably connected with the columns by connection elements establishing a form-locking connection, and of carrying arms for at least one table top mounted on the longitudinal beam. These components can be varied in many different ways and combined in the most different manners so that office desks optimally adapted in each case to the respective application can be realized with the same basic elements.

24 Claims, 14 Drawing Figures

OFFICE DESK, IN PARTICULAR FOR PERIPHERAL COMPUTER EQUIPMENT

The present invention relates to an office desk, in particular for peripheral computer equipment, comprising a table frame consisting of two side parts and a longitudinal beam connecting the two side parts, and a table top arranged between the side parts.

Office desks of this general design have been known heretofore in many different forms. One office desk of this type has been described and illustrated for example by German Patent Specification No. 32 07 177. The desk described meets all requirements as regards high stability and adaptability to different working conditions, having a table top which is adjustable both in height and in inclination.

Modern office work, and in particular the increasing use of word and data processing with its great variety of peripheral equipment, such as displays, mass storages and printers of different types, require a plurality of office desks of different construction to optimize their application. Terminals with keyboard, for example, require desks the table tops of which are composed of different sections arranged at different heights, while desks for printers need not necessarily offer large surfaces but should have certain facilities, for example for mounting baskets. It is true that special desk and frame designs meeting the particular requirements are available for each of these applications, but the production of such special designs is uneconomical.

Now, it is the object of the present invention to provide an office desk of the type described above which can be optimally adapted to many applications, either by modifications to be applied by the manufacturer, or through measures to be carried out by the user himself.

This object is achieved according to the invention by an arrangement characterized in that the side parts are formed by columns provided with feet, that the columns comprise connection elements which are positively engaged by matching connection elements provided on the longitudinal beam which is in turn connected detachably with the side parts, and that carrying arms for the table top are fastened on the longitudinal beam.

The office desk according to the invention therefore does not consist of one uniform frame and a table top adapted thereto. Rather, it is formed by a structure of several individual parts which can be detachably connected with each other and which can be exchanged to implement the most different table configurations. Depending on whether the side parts are provided with symmetrical or asymmetrical feet, either symmetrical or asymmetrical table structures may be realized at desire. The table structures which are of particular importance are, however, symmetrical ones, i.e. office desks in which the feet are provided in substantially symmetrical arrangement relative to the columns and the longitudinal beam is provided with carrying arms on its two sides. Apart from the fact that a common continuous table top may of course be placed on the carrying arms in the conventional maner, this embodiment of the invention offers the possibility to provide table tops of different design and/or structure on the two sides of the table in order to adapt the table optimally to specific applications. Further, one side of the table may be provided with a table top, while certain accessory equipment may be arranged on the other side of the longitudinal beam. In particular, the carrying arms may be arranged at different heights so that the desk offers several table top sections of different height which is very desirable for many peripheral computer equipment applications.

In a preferred embodiment of this invention, the ends of the longitudinal beam are provided with hooks for engaging matching recesses in the columns. This embodiment offers the particular advantage that in addition to making the production of a specific desk type particularly easy, it also offers the customer the possibility, when restructuring his office, to vary the desk structure by exchanging longitudinal beams and/or side parts so as to adapt his desks optimally to new applications. Such a possibility is of particular importance when—as provided by a further embodiment of the invention—a desk of this type comprises more than two columns and when the longitudinal beams interconnecting the columns are arranged in a line and/or at an angle relative to each other. Then the structure of such a desk comprising a greater number of side parts and longitudinal beams can be varied with extreme ease and well adapted to the new conditions.

In one special embodiment of the invention, the longitudinal beam takes the form of a vertical frame provided with connection members at its upper and lower edges. The use of such a vertical frame gives a structure of extremely high stability because the connection members act on the columns at a great distance thus providing a large supporting base. The use of such a frame offers the particular advantage that vertical members can be provided therein for mounting accessory equipment, in particular baskets for continuous forms. Such an office desk is particularly versatile in structure when the vertical members of the frames and/or the additional members mounted in the frames are provided with a number of preferably equally spaced elongated slots in which carrying arms and accessory equipment can be mounted by means of matching hooks.

A further particular advantage of the use of frames is seen in the fact that the connection members are arranged substantially along a vertical line so that the columns need not have a substantial horizontal extention. In a preferred embodiment of the invention, for example, the columns exhibit a circular cross-section and are provided with axially open, annular grooves which extend about their circumference and which are engaged by the hooks provided at the ends of the frame. Columns of circular cross-section can on the one hand be produced from corresponding raw material easily and at low cost and offer on the other hand the additional advantage that they are not restricted to certain specific directions for connection of longitudinal beams. Consequently, the annular grooves can easily receive several longitudinal beams which may form with each other almost any desired angle, and in particular, such columns may serve as system centers for star-like desk arrangements.

The annular grooves may be formed simply by sleeves placed on the column, the lower sleeve being open at its upward end, and the upper sleeve being open at its lower end. In this case, the vertical frame members may be provided conveniently with longitudinal slots which are open at their ends and which delimit hook-like portions of the vertical members for engaging the sleeves.

In a further embodiment of the invention, the columns are separated in the area of the annular groove, the column sections being interconnected by an insert element exhibiting an annular turned groove. The one column section ends flush with the one flank of the annular turned groove, while the other column section projects beyond the other flank of the turned groove but ends at a certain distance before the end of the one column section. Thus, the groove is formed between the interior of the one column section and the adjacent section of the turned groove in the insert element. Access to the groove is provided through the slot formed between the two spaced column sections. It is a particular advantage of this embodiment of the invention, that due to the fact that the column is composed of a number of different sections, additional possibilities are provided for varying the desk configuration. This applies in particular when the insert element is made up of two symmetrical portions being in contact which each other in the center plane, fastened in the respective column sections and connected with each other by a central screw bolt. In the case of this embodiment of the invention, each of the vertical frame members may be formed advantageously by a section provided with openings at its side adjacent the column, with connecting pieces exhibiting a projecting hook-shaped nose being inserted therein.

In another preferred embodiment of the invention, the longitudinal beam is designed as a box-shaped hollow body carrying connecting elements on its two vertical wall sections. The use of such a longitudinal beam designed as a box-shaped hollow body is of particular interest in cases where an office desk with a cable duct extending over its length is desired, because such a hollow body lends itself conveniently for use as cable duct. Where such a cable duct is required, the longitudinal beam may be provided advantageously with a longitudinal slot extending along its upper or lower face. If desired, a cover may be provided for the slot.

Since the stability of the connection between the columns and the longitudinal beams depends to a certain degree on the spacing of the connecting elements provided, the columns should advantageously exhibit an elongated cross-section in a plane vertical to the longitudinal beam, when a longitudinal beam in the form of a box-shaped hollow body is used, and should be provided, at least on the side facing the longitudinal beam, with two parallel rows of equally spaced longitudinal slots intended to be engaged by hooks provided at the ends of the longitudinal beam. This embodiment of the invention offers the advantage that connecting elements designed as hooks can be provided on the longitudinal beam and introduced into the longitudinal slots of the column at both a lateral and a vertical distance. In this manner, a very high stability of the table frame can be achieved. At the same time, the arrangement of a number of longitudinal slots in rows permits the longitudinal beam to be mounted on the columns in any vertical position, and it is also possible to provide several longitudinal beams in superimposed position when table frames of particularly high stability or with certain special equipment are required.

While in the case of the embodiment of the invention described at the outset, the connection between the longitudinal beam and the columns is prevented from detaching unwantedly by the oppositely directed openings of the annular grooves, such unwanted detachment can be prevented in the case of the embodiment using the box-shaped longitudinal beam in a simple manner by providing, next to at least one of the hooks, a bolt mounted for displacement in the longitudinal direction of the longitudinal beam and being preferably spring-loaded towards the end of the longitudinal beam for engaging the same longitudinal slot of the column as the hook itself, but at a point above the hook, thus preventing the hook from being lifted off the slot. On the other hand, the connection can be released at any time by retracting the bolt, without damaging any of the interconnected components.

In a preferred embodiment of the invention, the hooks and the bolts, if any, are disposed on an insert introduced into the ends of a hollow section forming the longitudinal beam. The use of such inserts that can be introduced into the hollow sections forming the longitudinal beam, help to reduce the production costs by providing the possibility of producing uniform components in large numbers and using them for desks of different structures. This possibility is of particular importance where longitudinal beams of different, but modular, dimensions are provided for the purpose of permitting the implementation of office desk structures following a modular system.

Further, the use of an insert introduced into the hollow section makes it possible to clamp the longitudinal beam against the column, by arranging the insert in the hollow section so that it can be displaced and moved by means of an eccentric towards the interior of the hollow section. After the insert has been connected with the column via its hooks, the insert is displaced towards the interior of the hollow section so that the end of the hollow section is moved against the column and, thus, clamped on the latter. This permits a table frame of extraordinarily high stability and load-carrying capacity to be obtained.

In one particularly preferred embodiment of the invention, the eccentric is formed by a rod seated transversely in the insert for eccentric rotation therein and engaging stops disposed in the hollow section. Such a rod is easily accessible for rotation through slots or openings provided in the hollow section and offers high stability so that high clamping forces can be applied in this manner. In addition, such a rod may be designed in such a manner that it can be mounted in the insert even after introduction of the insert into the hollow section so that the stops provided for engagement by the rod do not hinder the introduction of the insert.

Columns having an elongated cross-section may consist in a particularly advantageous manner of two hollow sections of substantially rectangular cross-section which carry on their narrow adjacent faces outwardly open U-shaped rails the legs of which are provided with longitudinal slots, and further a center web interconnecting the hollow sections and carrying on its two edges U-sections embracing the U-shaped rails. In this manner, a column is obtained which is symmetrical in relation to two longitudinal center planes extending transversely relative to each other, and which is composed of very simple and at the same time very solid parts. The outer sections, which exhibit a substantially rectangular cross-section, may on the one hand accommodate elements for connecting individual sections of the column with each other or with the foot, and may on the other hand also partly serve as cable ducts. The U-shaped rails form together with the hollow sections a very solid structure for realizing the connection with the longitudinal beam. The use of a center web for connecting the outer sections offers the advantage that the two outer sections may have the same shape and a smaller diameter, an aspect which is of great importance as regards production economy. At the same time, a particularly solid structure is achieved in conjunction with the center web which is again extremely easy to produce. In a particularly simple design, the center web may consist of two sheet-steel sections which may be arranged symmetrically relative to the connection plane between the two hollow sections, and whose edges may be bent off outwardly to form the U-sections embracing the U-shaped rails.

The table tops of the office desk according to the invention may rest on the carrying arms and may be fixed thereon in the conventional manner, for example by means of screws passed from below through the carrying arms and screwed into the table top. When the longitudinal beams are provided with facilities for detachably mounting the carrying arms, for example again with slots that can be engaged by arms provided at the ends of the carrying arms, table tops of different designs can be supplied with carrying arms fixed thereon. It is, however, also possible to mount such table tops detachably on carrying arms fixed to the longitudinal beams to permit the table tops to be exchanged as required. Here again, the firm connection between the table top and the carrying arm is achieved in the first line by the fact that the table top rests on the carrying arms. Then the table top can be secured in a detachable manner by means of bolts arranged on the lower face of the table top and engaging recesses disposed in the carrying arms. Such bolts may be hinged in particular on a supporting frame arranged on the lower side of the table top in a manner to fit between the carrying arms, and in the locked position the ends of the bolts may engage recesses provided in the sides of the carrying arms facing each other so that the position of the table top relative to the table frame is defined through the bolts coacting with one flank of the recess.

Further possibilities to vary and adapt the office desk of the invention to specific applications can be achieved easily due to the fact that at least one of the side parts can be extended beyond the height of the table top by the use of a suitably adapted extension piece. The latter may again be provided with one or more carrying arms for additional table top elements and/or with mounting means for additional accessories. Further, at least one of the side parts may be provided, at its outerside facing away from the longitudinal beam, with at least one carrying arm, preferably having the shape of a shorter longitudinal beam, for receiving an additional table top element, or with mounting means for additional accessories. As regards the preferred embodiments of the invention described before, both the annular grooves provided on the column of circular cross-section, and the parallel rows of longitudinal slots which in the case of the described symmetrical structure of the column are found also on the outsides of the columns, offer the possibility to connect several longitudinal beams to a single column thus permitting even complex desk structures of the most different designs to be implemented.

The invention will be explained hereafter in detail and described with reference to the embodiments shown in the drawing. The features apparent from the specification and the drawing may be used in other embodiments of the invention either individually or in any desired combination thereof. In the drawing.

Figure 1:
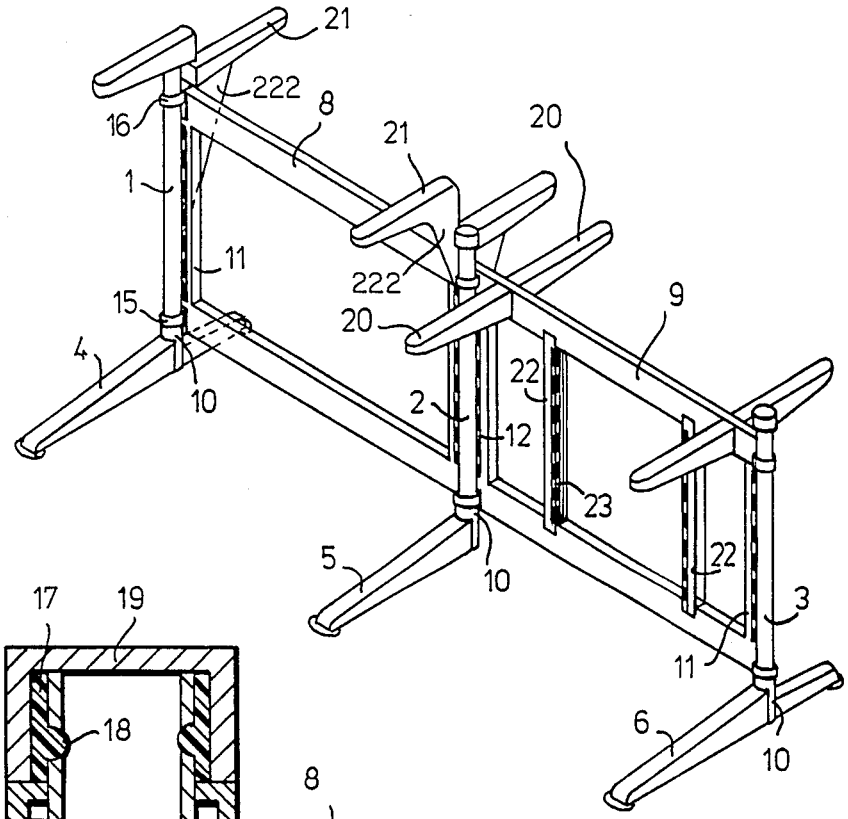
FIG. 1 shows a diagrammatic representation of the frame of a first embodiment of the office desk of the invention, without any table tops.

The frame of an office desk illustrated in FIG. 1 comprises three columns 1 to 3 equipped with feet 4 to 6 and interconnected in pairs by frame-like longitudinal beams 8 and 9. The feet 4 to 6 extend substantially transversely to the plane defined by the frame-like longitudinal beams 8, 9. The feet 4 and 6 provided on the outer columns 1 and 3 extend in both directions from the said plane, while the middle foot 5 extends only in one direction from the said plane. The design and arrangement of the feet may vary according to the loading, depending on the particular application of the office desk. The columns 1 to 3 are formed by tubes of circular cross-section fitted and fastened in corresponding sleeves 10 of the feet.

Figure 2:
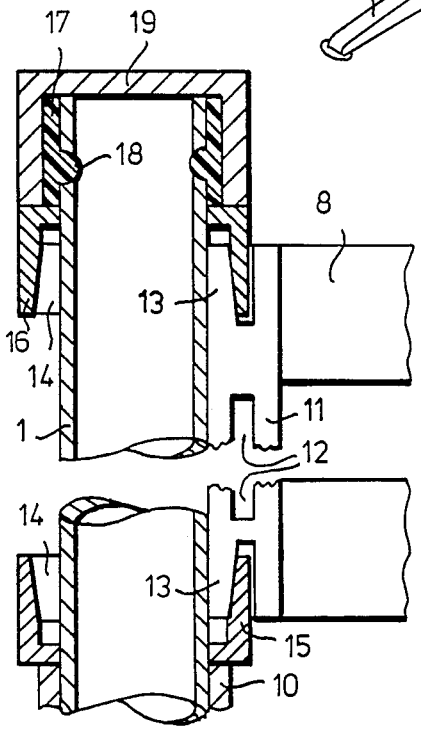
FIG. 2 shows a vertical cross-section through the upper end of one column of the table frame shown in FIG. 1.

The frame-like longitudinal beams 8 and 9 are detachably connected with the associated columns 1 and 2 or 2 and 3 by form-locking connection elements. As can be seen best in FIG. 2, the vertical members 11 of the beams are provided with a number of equally spaced longitudinal slots 12. The longitudinal slots located at the respective ends of the members 11 are open towards the ends of the members and define in this manner a hook-like portion 13 by which the vertical elements 11 engage annular grooves 14 formed by sleeves 15, 16, fitted on the column. As appears from FIG. 2, the lower sleeve 15 is in contact with the sleeve 10 of the foot and is open on its upper side. The annular groove 14 thereby formed is engaged by the hook-like portion 13 formed at the lower end of the vertical member 11 of the frame-like longitudinal beam 8. A downwardly open sleeve 16 fitted on the column 1 extends analogously over the hook-shaped portion 13 formed on the upper end of the vertical member 11. The sleeve 16 is retained by a plastic collar 17 fitted on the column 1 above the sleeve 16 and locked in place by projections 18 coacting with corresponding bores in the column 1. The collar 17 may consist of a material of limtied elasticity exerting a certain pressure also in the axial direction, thus ensuring the play-free positive connection between the sleeves 15,16 and the hook-like sections 13 of the vertical member 11 of the frame-like longitudinal beam 8. A cap 19 fitted upon the collar 17 secures the latter in place and seals the column off tightly at its upper end.

Carrying arms extending laterally or transversely to the longitudinal beams 8, 9 are provided as supports for the table top elements. The carrying arms may be mounted in a number of different ways. In the embodiment shown in FIG. 1, the carrying arms 20 are fixed directly to the upper longitudinal member of the frame-like longitudinal beam 9, for example by welding. Other carrying arms 21 are, however, provided at their bottom faces with supporting arms 222 comprising hooks at their edges facing the frame-like longitudinal beam 8, for engaging the longitudinal slots 12 of the vertical members 11 of the said longitudinal beams. This arrangement permits such carrying arms 21 to be provided on both laterally facing sides of the longitudinal beam 8 at different heights, as illustrated in FIG. 1. This makes it possible to realize a vertically stepped table top which is of particular advantage for use with terminals with keyboard.

The frame-like design of the longitudinal beam 9 does not only provide high stability of the table top because the connection between the longitudinal beam and the column is realized at widely spaced points, but permits in addition the insertion of vertical members 22 which, similar to the vertical members 11 of the frame-like longitudinal beams, are provided with longitudinal slots 23 for mounting carrying arms and additional accessories.

Figure 3:
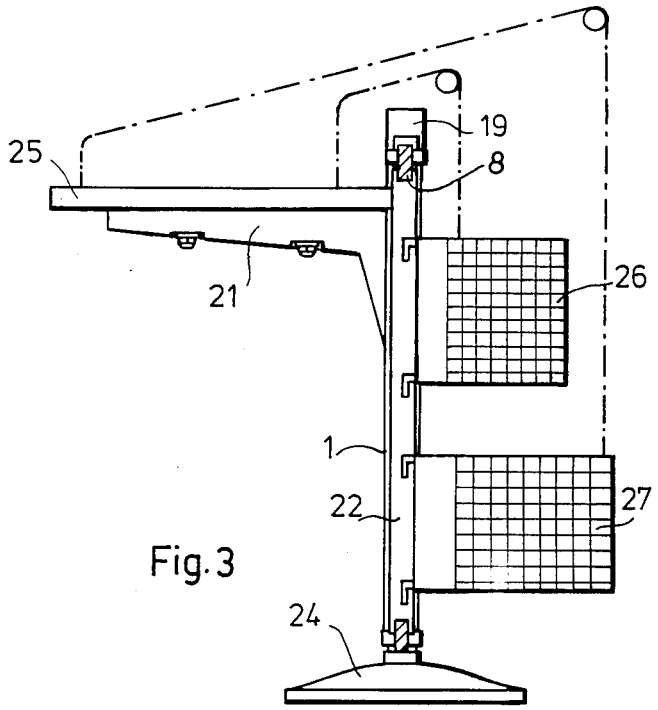
FIG. 3 shows a cross-section through a second embodiment of an office desk similar to that shown in FIG. 1, with mounted table top and additional accessories.

FIG. 3 shows a variant of the office desk shown in FIG. 1, wherein the columns 1 are provided with mushroom-shaped feet 24. The carrying arms 21 are arranged on one side of the longitudinal beam 8 only and provided with a table top 25. The table top 25 is fastened to the carrying arms 21 by means of screws passed through the carrying arms 21 from below. On the side of the longitudinal beam 8 opposite the table top 25, continuous form baskets 26, 27 are arranged, both of them being mounted by means of hooks engaging the longitudinal slots of vertical members 22 which are in turn inserted in the hook-like longitudinal beam 8. This office desk, with the table top provided on its one side and the continuous form baskets provided on its other side, is particularly well suited for use with a printer.

Figure 4:
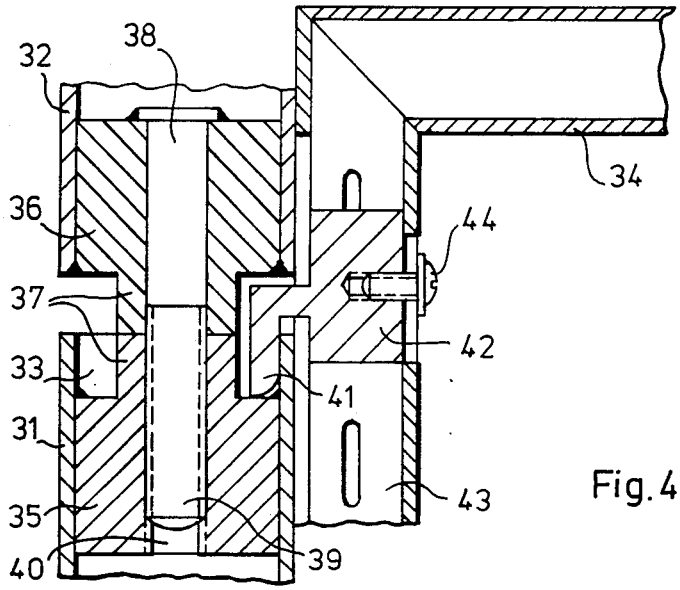
FIG. 4 is a vertical cross-section through certain sections of one column and an adjacent longitudinal beam of another embodiment of an office desk according to the invention.

The variant of an office desk according to the invention shown in FIG. 4 comprises columns composed of several sections adjoining each other in the area of an annular groove 33 which serves to attach a frame-like longitudinal beam 34. For forming the said annular groove 31 and for connecting the column sections 31, 32 two parts 35, 36 are inserted in these column sections which form together an insert element. Each of the parts 35, 36 consists of a cylindrical body followed by a portion 37 of reduced diameter. The parts 35, 36 are mounted in the column sections 31, 32 in such a manner that the portions 37 of reduced diameter face the ends of the column sections. The part 36 is fitted in the upper column section 32 so that the end face formed at the transition to the portion 37 of reduced diameter ends flush with the end of the tubular column section 32, while the part 35 is fitted in the lower column section 31 so that the end of the tubular column section ends flush with the end face of the portion 37 of reduced diameter. The parts may be fixed in the respective column sections by welding. Further, a screw bolt 38 is enclosed in a central bore in the one part 36. The said screw bolt comprises a threaded shank 39 which projects from the portion 37 of reduced diameter and which is screwed into a central threaded bore 40 provided in the other part.

The annular groove 33 which is defined on the one hand by the insert element 35, 36 and on the other hand by the projecting edge of the lower column section 31 is engaged by a hook-shaped nose 41 provided on a connecting piece 42 fitted in the vertical member of the frame-like longitudinal beam 34 which is formed by an angle section 43. In the embodiment shown, the connecting piece 42 which is positively guided in the angle section 43, is fixed in position by means of a screw 44. This arrangement offers the particular advantage that the column of the office desk can be built up as desired from sections of different lengths and that moreover frame-like longitudinal beams of different heights may be used at any time. In such a case, the connecting pieces 42 permit the frames and, thus, any components mounted thereon to be vertically adjusted. On the other hand, it would be possible to provided the vertical member with a number of spaced longitudinal slots also on its side facing the column, which slots would then be engaged by corresponding connecting elements held within the vertical member by chipboards arranged therein. This would provide a form-locking connection of particularly high load-carrying capacity.

The embodiment shown in FIGS. 5 to 9 is insofar identical to the embodiments discussed before as its side parts comprising columns 52 and feet 51 are interconnected to form a table frame by means of a longitudinal beam 53. The connection is again realized by hooks 54 provided at the ends of the longitudinal beam 53 and engaging, in form-locking relationship, corresponding recesses in the columns 52. Carrying arms 55 are mounted on the longitudinal beam 53 for receiving table tops 56. The difference between this embodiment and those discussed before lies substantially in the shape of the columns 52 and the longitudinal beam 53.

Figure 6:
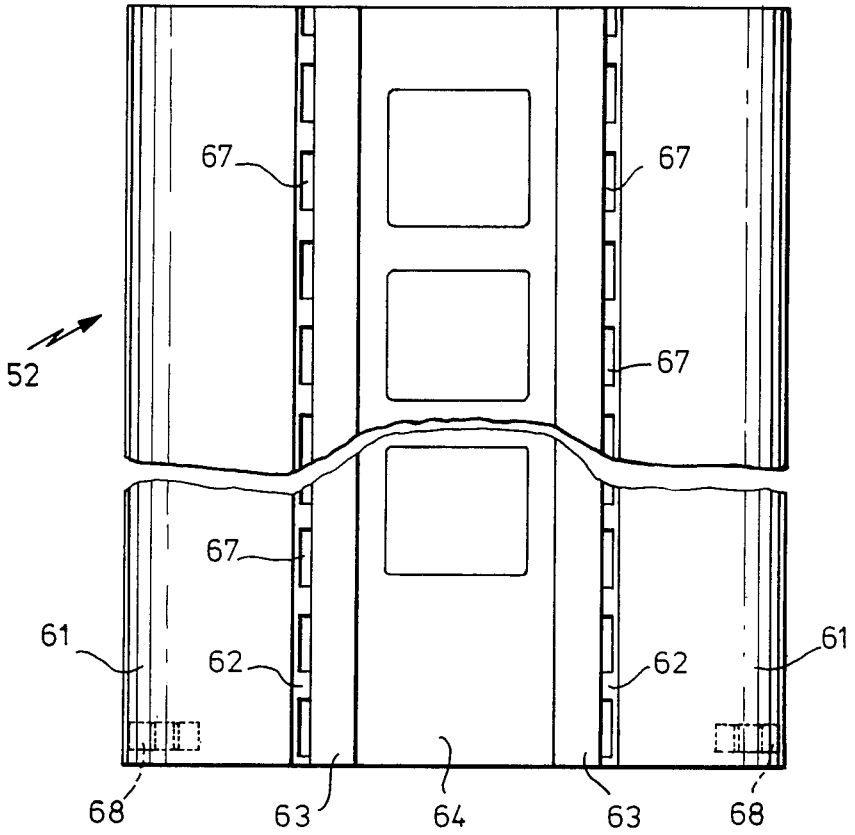
FIG. 6 is a side view of a certain section of the column of the office desk shown in FIG. 5.
Figure 7:
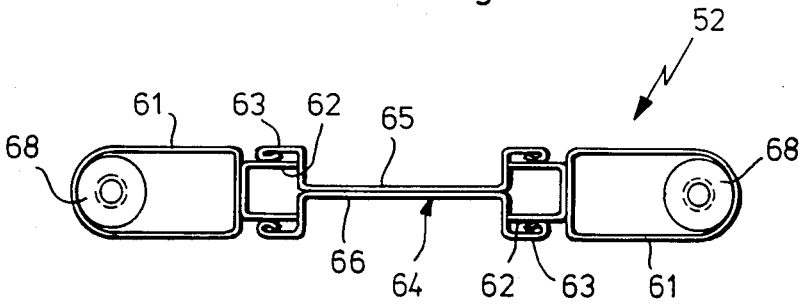
FIG. 7 shows a cross-section through the column according to FIG. 6.

As will be seen best in FIGS. 6 and 7, the column 52 comprises two parts or sections 61 which, although being rounded on their sides pointing to the outside, exhibit a substantially rectangular cross-section. The hollow sections 61 are provided on their narrow sides facing each other with outwardly open U-shaped rails 62 whose legs engage U sections 63 which are provided on the edges of a center web 64 connecting the U rails 62 and, thus, also the hollow sections 61. By this arrangement, a very solid structure is obtained which requires little space and which in addition offers the advantage of being composed of only a few sections. The structure obtained is symmetrical relative to a plane containing the longitudinal center plane of the two hollow sections and also to a center plane extending transversely thereto. The center web is made up of two sheet-steel sections 65, 66 arranged symmetrically relative to the connection plane between the two hollow sections 61 and whose wedges are bent off outwardly thus forming the U sections 63 embracing the U rails 62. For the purpose of establishing a connection with the longitudinal beam 53, the legs of the U rails 62 are provided with longitudinal slots 67 for engagement by the hooks 54 provided at the ends of the longitudinal beam. Further, mounting means, such as the nuts 68 shown in FIGS. 6 and 7, are arranged in the hollow sections 61, for the purpose of establishing the connection to adjacent components, such as the feet 51.

Figure 5:
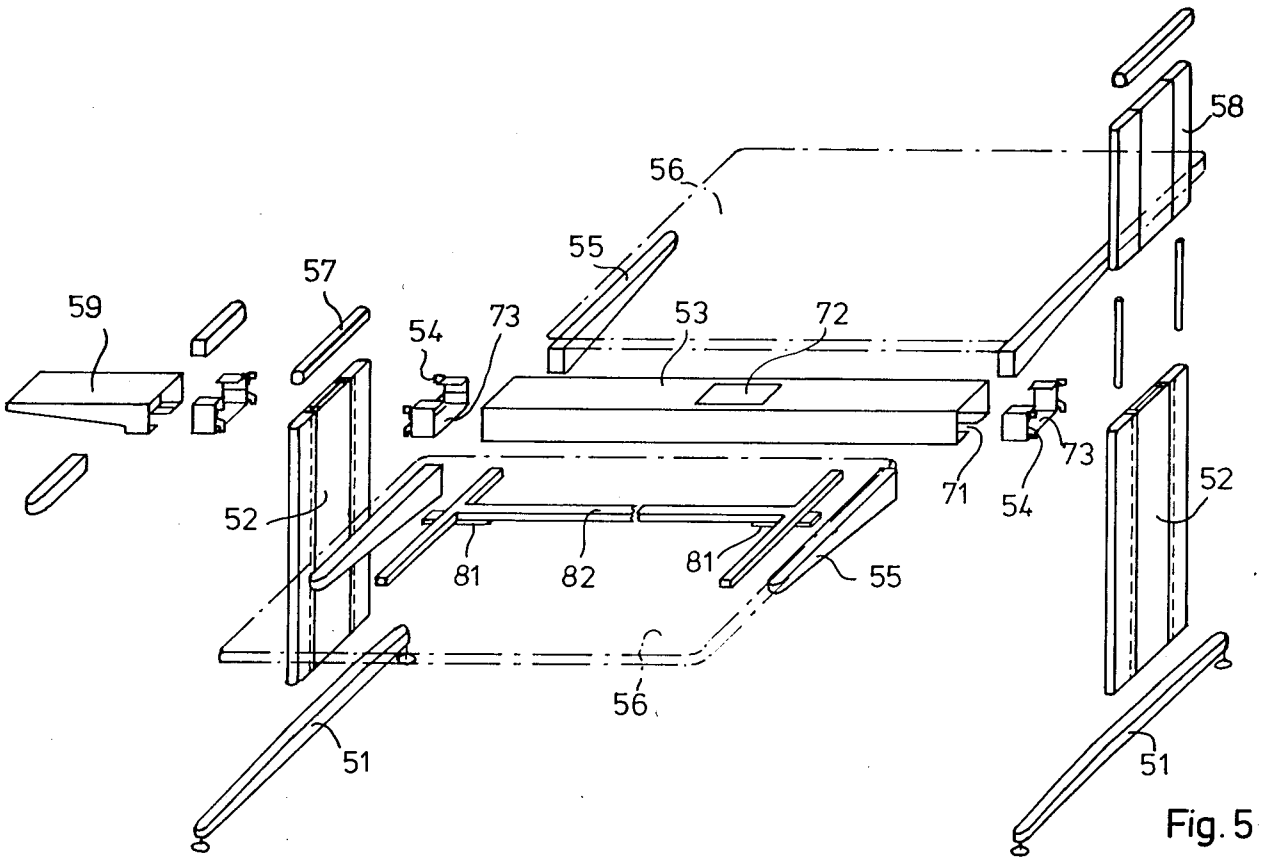
FIG. 5 shows an exploded view of still another embodiment of an office desk according to the invention.
Figures 8, 9:
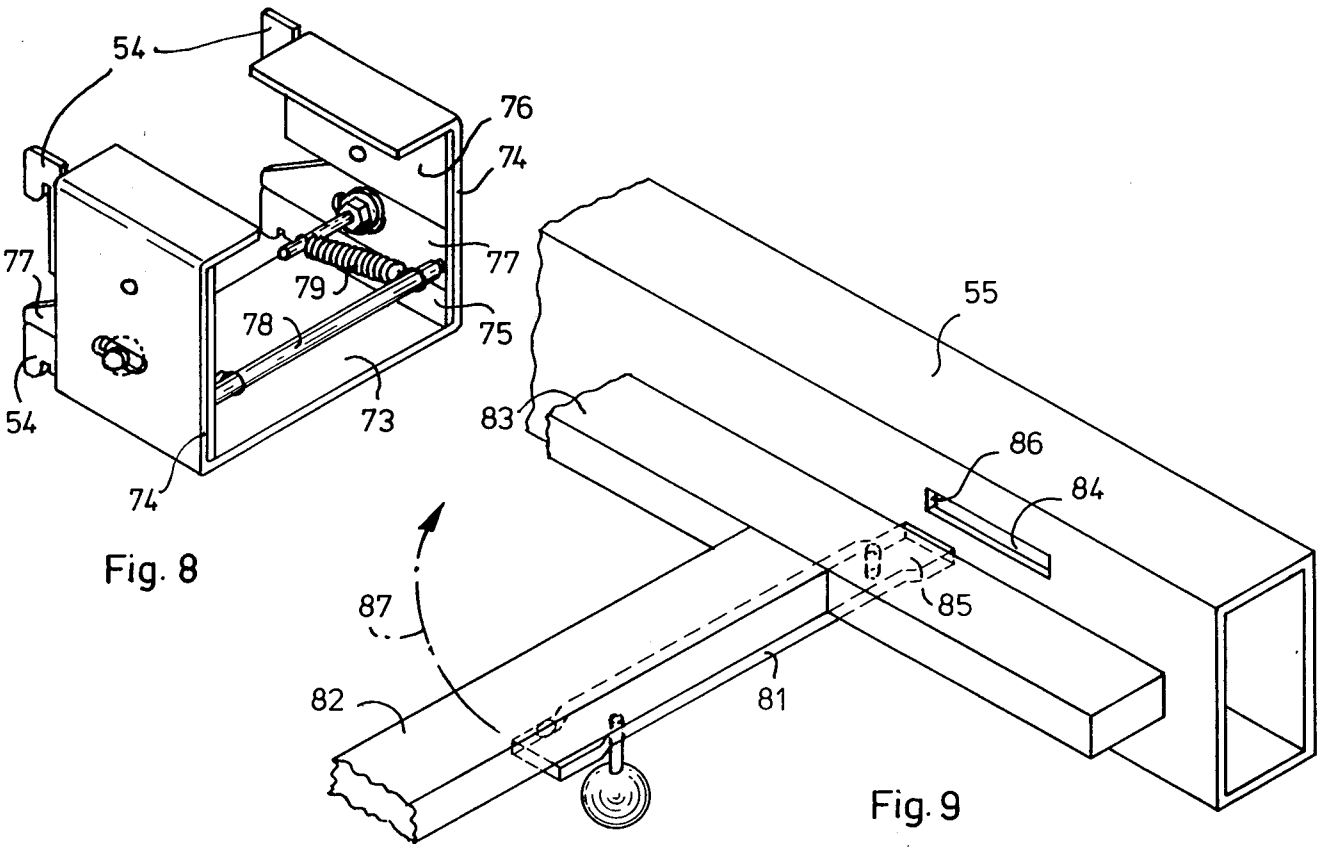
FIG. 8 shows an insert for the longitudinal beam of the office desk according to FIG. 5, in enlarged scale.
FIG. 9 shows the means for connecting the table top with the carrying arms of the office desk according to FIG. 5, also in enlarged scale.
Figure 10:
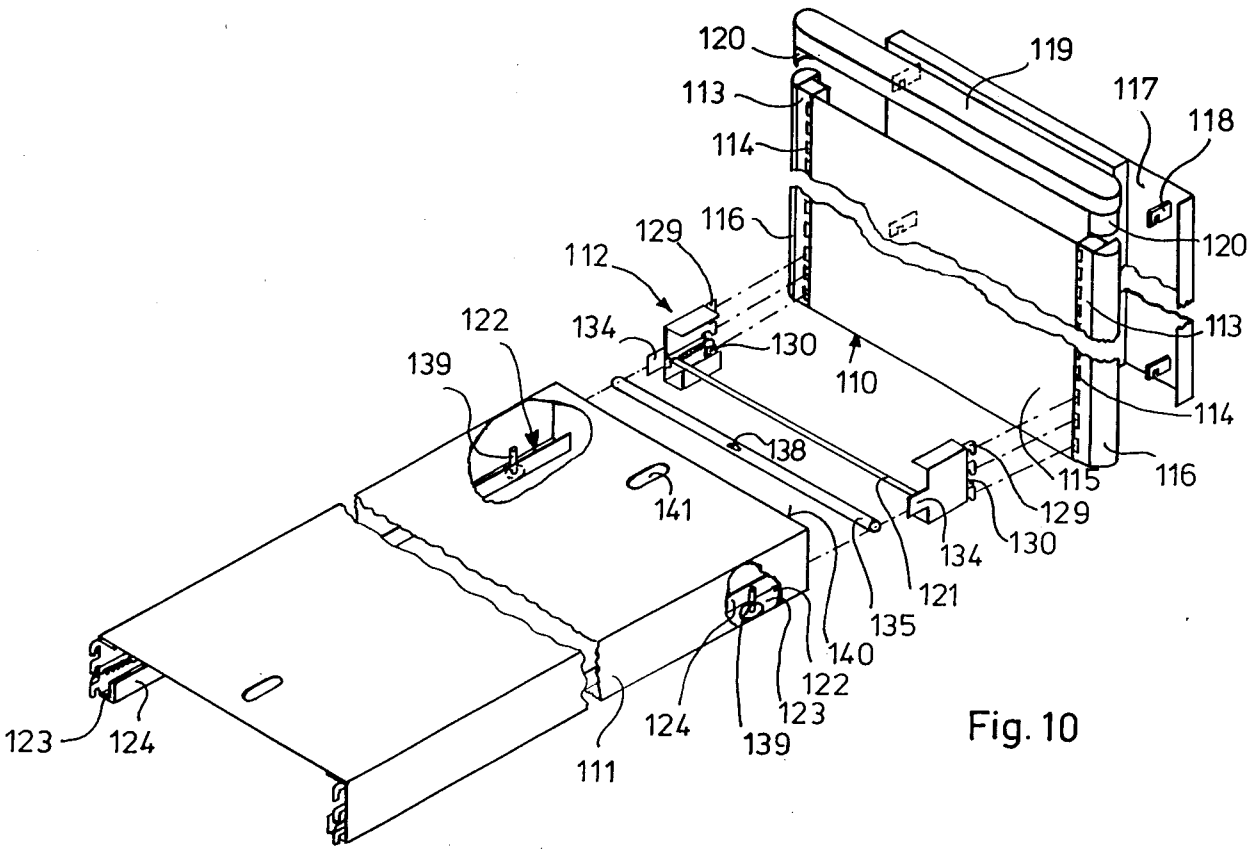
FIG. 10 shows an exploded view of another embodiment of the column and the longitudinal beam of an office desk according to the invention.
Figure 11:
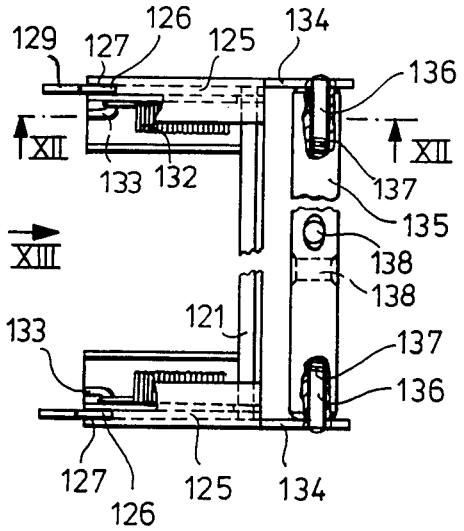
FIG. 11 is a top view of the insert of the office desk according to FIG. 10 serving to connect the longitudinal beam and the column.
Figure 12:
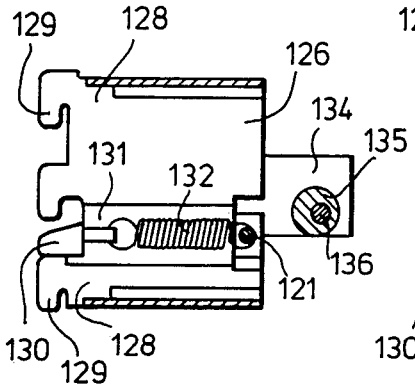
FIG. 12 shows a cross-section through the insert of FIG. 11, taken along line XII—XII.
Figure 13:
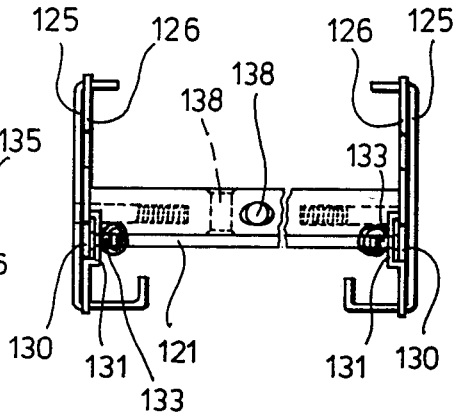
FIG. 13 is a view of the insert according to FIG. 11, in the direction of arrow XIII.

In the embodiment shown in FIG. 5, the longitudinal beam 53 consists of a box-shaped hollow body with a longitudinal slot 71 provided in its lower face which permits electric lines to be accommodated. Further, the upper side of the longitudinal beam is provided with a central opening 72 which can be closed by a cover, if desired. This design of the longitudinal beam allows the latter to be used as a cable duct. The hooks 54 establishing the connection with the columns 52 are not provided on the longitudinal beam 53 itself, but rather on inserts 73 which are introduced into the ends of the longitudinal beam 53 and fixed therein. As can be seen in FIG. 8, such an insert 73 consists of a substantially U-shaped component whose transverse web spans the longitudinal slot 71 in the lower face of the longitudinal beam 53. Two plates 75 and 76 are fixed to the insides of the two legs 74, each having one end projecting beyond the lateral edge of the leg 74 to form a hook 54. A bolt 77 is seated between each pair of plates 75, 76 for displacement in the longitudinal direction of the longitudinal beam. The two bolts 77 are interconnected at their ends opposite the hook 54 by a bar 78 which is subjected to the action of spiral tension springs 79 tending to retain the bolt in its inoperative position in which the pointed ends adjacent the hooks 54 engage the same longitudinal slots 67 of the columns as the neighboring hook 54. The spiral tension springs 79 ensure that the section of the respective longitudinal slot 67 above the hooks is completely filled by the tip of the bolt 77 which makes it impossible to lift the neighboring hook 54 out of the longitudinal slot of the column 52. This ensures a very secure connection between the longitudinal beam 53 and the columns 52 which can, however, easily be released after retraction of the bolt 77.

As has been mentioned before, carrying arms 55 for the table top 56 are mounted on the longitudinal beam 53. The carrying arms may be attached to the longitudinal beam either by welding, screwing or in any other manner. In the embodiment shown in FIG. 5, one table top 56 each is provided on both sides of the longitudinal beam 53. The table tops rest on, and are securely supported by the carrying arms 55. The table tops 56 are likewise detachably mounted on the carrying arms 55 so that they can be exchanged easily with other table tops having, for example, a different shape and/or a different surface. It is of course also possible to exchange the table tops with any additional accessories.

The connection between the table top 56 and the carrying arms 55 is realized in the illustrated embodiment by locking bolts 81 pivoted on a supporting frame 82 which is in turn fastened to the lower face of the table top 56. The supporting frame 82 consists substantially of a strip extending in parallel to the longitudinal beam 53 and carrying on its ends transverse strips 83 fitting just between the carrying arms 55 provided on the longitudinal beam 53. The inner sides of the carrying arms 55 which face each other are provided with recesses 84 which are engaged each by the short arm 85 of a bolt 81 when the latter occupies the locking position illustrated in FIG. 9. In this position, the lateral face of the short arm 85 bears against the outer flank 86 of the recess 84 in the carrying arm 55, thus urging the table top 56 against the lateral face of the longitudinal beam 53. By pivoting the bolts 81 in the direction of arrow 87, the bolt 81 can be disengaged from the carrying arm 55, whereafter the table top can be detached from the carrying arms.

FIGS. 10 to 13 show the essential components of a further embodiment of an office desk which distinguishes itself by particularly high stability. The high stability is obtained by the great width of the columns 110 and the longitudinal beam 111 which provide a large supporting base, and also by the particular design of the insert 112.

The column 110 consists of two square tubes 113 which are provided in spaced arrangement and whose oppositely arranged outer faces are again provided with a number of spaced longitudinal slots 114 serving for mounting other components. The two square tubes 113 are interconnected in the plane of one of their lateral faces by a plate 115, while the outer faces of the square tubes 113 are adjoined by rounded sections 116. The latter are larger in width than the square tubes 113, thus defining a space for insertion of a cover plate 117 which is provided on its inner face adjacent the square tubes 113 with hooks 118 which can be engaged in the longitudinal slots 114 of the square tubes 113 for mounting the cover plate 117 on the column. Accordingly, the cover plate 117, being detachably fastened to the square tubes 113 of the column 110 by means of the hooks 118, can be easily exchanged to adapt the outer appearance and color of the table frame to existing furniture. If desired, the overall appearance of the desk may also be influenced by giving the cover plates a particular shape. The upper end of the column 110 is sealed off by a cover 119 with projections 120 fitting into the rounded sections 116 provided on its ends.

In this embodiment, too, the longitudinal beam 111 consists of a downwardly open box-shaped section of a width adapted to the spacing of the square tubes 113 of the columns 110. The insert 112 serving to connect the longitudinal beam 111 and the column 110 is made up in this embodiment from two separate parts connected only by a rod 121 corresponding to the rod 78 of the insert shown in FIG. 8. Each of the two parts of the insert 112 is guided for sliding movement in a channel 122 formed by bent-off or curled edge portions 123, 124 of the longitudinal beam 111.

The two parts forming the insert 112 consist each of one bearing bracket 125 fitting into the channel 122 and carrying on its inside a hook portion 126. The position of the hook portion 126 in the bearing bracket 125 is defined by slots 127 provided in the bearing bracket and engaged by projections 128 arranged on the upper and lower edges of the hook portions 126. A section of the hook portion 126 projecting on the front end of the bearing bracket 125 carries three superimposed hooks 129 the size and spacing of which is adapted to the longitudinal slots 114 in the square tubes 113. The use of three hooks 129 engaging three neighboring longitudinal slots 114 of the square tubes 113 provides an extremely high load-carrying capacity of the connection between the longitudinal beams and the columns.

Similar to the embodiments shown in FIGS. 5 to 9, the hooks 129 are also secured in this embodiment in the longitudinal slots 114 by a bolt 130 mounted to slide in a channel 131 which has been formed by bending of the hook portion 126. The action of this bolt is identical to that of the bolts of the embodiments shown in FIGS. 5 to 9. Here, too, the spiral tension spring 132 tends to retain the bolt 130 in its locked position. The spiral tension springs 132 act upon the bar 121 connecting the individual parts of the insert and engage by their opposite ends hooks 133 projecting from the hook portion 126 in the area of the channel 131.

The bearing brackets 125 are equipped on their rear edge opposite the hooks 129 with one lug 134 each. The lugs of the parts united to form an insert 112 serve as a bearing for an eccentric formed by a rod provided in its end faces with axial, but eccentrically arranged bores. The bores accommodate pivot pins 136 the inner ends of which bear, via helical pressure springs 137, against the bores in which they are seated. In the area of their center, the eccentric 135 comprises two adjacent transverse bores 138 extending at a right angle relative to each other. The eccentric 135 serves to coact with stops 139 arranged within the channels 122 of the longitudinal beam 111 and formed in the embodiment shown by pins fixed in the edge portion 123.

For connecting the longitudinal beam 111 with the column 110, the parts of the insert 112 are fitted in the channels 122 of the longitudinal beam 111, with the eccentric 135 not yet engaged in the lugs 134. So, the lugs can be moved past the stops 139 in the channels 122 without any difficulty. Thereafter, the eccentric 135 is fitted by pressing the pivot pins 136 into the lugs 134 of the insert parts so that the eccentric 135 comes to lie behind the stops 139, relative to the open end 140 of the longitudinal beam. Then the longitudinal beam can be fitted by engaging the hooks 129 of the insert in the longitudinal slots 114 of the square tubes 113 of the column 110. It would be possible also to connect the insert with the column first, to mount thereafter the longitudinal beam on the insert, and to engage the eccentric thereafer in the lugs 134 of the insert. By inserting an arbor into the transverse bores 138, the eccentric 135 can then be rotated in such a manner that its circumference comes to rest against the stops 139 and that the stops are displaced relative to the insert 112 towards its hook whereby the end 140 of the longitudinal beam 111 is urged against the adjacent column surface. The angle between the surface of the eccentric and the stops 139 is very small so that very high clamping forces can be exerted and, in addition, a self-locking effect is achieved which ensures extraordinarily high stability of the connection. Rotation of the eccentric by means of an arbor introduced into the transverse bores 138 may be effected either through the open bottom of the longitudinal beam 111 or through an opening 141 arranged in the upper side of the beam.

It will be easily seen that due to the relative action between the eccentric and the stops each of the two parts of the insert 112 acts independently of the other so that no rigid transverse connection between the two parts is required. Further, it will also be easily seen that once the connection has been effected, it can be easily detached again after releasing the eccentric so that the individual components can be re-used for implementing other desk configurations.

Figure 14:
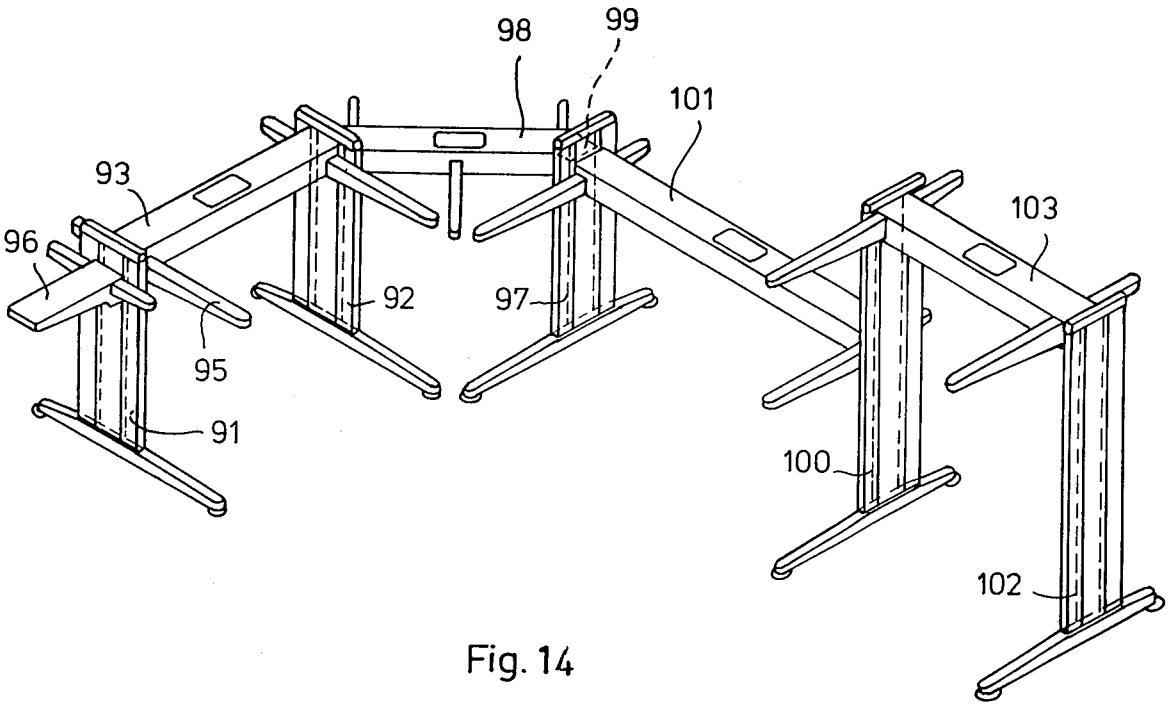
FIG. 14 shows a diagrammatic representation of an office desk comprising several columns, using the basic elements of FIG. 5, without the table tops and other accessories.

Similar to the office desks according to FIGS. 1 to 4, the office desks according to FIGS. 5 to 9 and 10 to 13 can be varied in many ways and adapted to many specific applications. The size and height of the desk, for example, may be varied without any difficulties, simply by using columns 52, 110 of different lengths or longitudinal beams 53, 111 of different lengths. The column which extends right to the height of the desk, can be covered up by a cover 57 (FIG. 5) or extended by an extension 58. In this case, supporting elements 59 similar in design to the longitudinal beam 53 can be connected also to the outside of a column 52. It oges without saying that similar supporting elements can be connected also to the extension 58 of the column. In addition, desk combinations can be implemented in which several columns are connected in pairs by longitudinal beams. FIG. 14 shows an example of such an arrangement. A longitudinal beam 93 is arranged between the two left columns 91, 92 at a height which ensures that a table top mounted on the carrying arms 95 has just the right height for a desk. On the outer side of the left column 91, a supporting element 96 is provided which permits a table top to be mounted a little lower, which may be desirable for example for typewriters, calculators or other office equipment.

Proceeding further in clockwise direction, the column 92 is followed by a column 97 connected with the column 92 by a longitudinal beam 98 equipped at its ends with bent-off or angled projections 99 so that the longitudinal beams 93, 98 and 101 are arranged at angles relative to one another and a corner desk is obtained. The longitudinal beam 98 is connected to the columns 92, 97 by means of inserts fixed in the projections 99 at each end of the beam in the same manner, as the insert 73 of the embodiment of FIGS. 5–9 or the insert 112 in the embodiment of FIGS. 10–13. The beam 98 is mounted a little lower than the longitudinal beam 93 of the neighboring desk frame which makes this corner desk again suited for office equipment. The column 97, in combination with the column 100 and the longitudinal beam 101, form again the frame of an office desk.

The column 101 extends beyond the normal desk height to the height of a so-called high desk, and the outer column 102 which is connected with the column 100 through a longitudinal beam 103, also has the same height.

FIG. 14 is intended to illustrate that the invention provides the possibility to implement office desks of the most different configurations and to arrange the table tops in each case at the height optimally suited for the purpose. The user of such office desks can at any time vary such configurations and may even supplement them as needed. As in the case of the embodiment shown in FIGS. 1 to 4, it is also possible in the embodiments shown in FIGS. 5 to 9 and 10 to 13 to mount several longitudinal beams in the columns at different heights, for example for arranging table tops at different heights or for providing supports for additional accessories of the most different types. By having available components of different dimensions fitting, however, into a modular system, it is possible with all the embodiments of the invention to provide furniture systems suitable for being adapted easily and optimally to all applications encountered in practice.

We claim:

1. Office desk, in particular for peripheral computer equipment, comprising a table frame consisting of two side parts and a longitudinal beam connecting the two side parts, and a table top arranged between the side parts, characterized in that the side parts are formed by columns provided with feet, that the columns comprise connection elements which are positively engaged by matching connection elements provided on the longitudinal beam which is detachably connected with the columns, and that carrying arms for at least one table top are fastened on the longitudinal beam.

2. Office desk according to claim 1, characterized in that the feet are arranged substantially symmetrically relative to the columns and that the longitudinal beam is provided on its two opposite laterally facing sides with carrying arms arranged preferably at different heights.

3. Office desk according to claim 1, characterized in that the ends of the longitudinal beam are provided with hooks engaging matching recesses in the columns.

4. Office desk according to claim 3, characterized in that the desk comprises more than two columns and that the longitudinal beams connecting the columns are arranged in a line and/or at an angle relative to each other.

5. Office desk according to claim 1, characterized in that the longitudinal beam is designed as a vertically arranged frame provided with connection elements near its upper and lower edges.

6. Office desk according to claim 5, characterized in that the frame comprises vertical components provided with a number of preferably equally spaced longitudinal slots for mounting additional accessories equipped with matching hooks, including carrying arms and continuous form baskets.

7. Office desk according to claim 5, characterized in that the columns exhibit a circular cross-section and axially open annular grooves extending about their circumference for engagement of hooks provided at the ends of the frame.

8. Office desk according to claim 7, characterized in that the annular grooves are formed by sleeves fitted on the column, the lower sleeve being open on its upper end and the upper sleeve being open on its lower end, and that the vertical members of the frames are provided with longitudinal slots which are open at their ends and which delimit hook-like portions of the vertical members engaging the sleeves.

9. Office desk according to claim 7, characterized in that the columns are separated in the area of the annular groove and that their sections are interconnected by an insert piece comprising an annular turned recess, and that the one column section ends flush with the one flank of the annular turned recess, while the other column section projects beyond the other flank of the turned recess, but ends at a certain distance from the end of the one column section.

10. Office desk according to claim 9, characterized in that the insert piece is made up from two symmetrical parts which are in contact with each other in the center plane of the turned recess and which are fixed in the respective column sections and connected with each other by a central screw bolt.

11. Office desk according to claim 9, characterized in that the frames comprise vertical members which are formed each by one section provided with openings at its side adjacent the column and that connecting pieces with a projecting hook-shaped projection are inserted in the said section.

12. Office desk according to claim 1, characterized in that the longitudinal beam is designed as box-like hollow body provided with.connection elements on the ends of its two vertical wall portions.

13. Office desk according to claim 12, characterized in that the longitudinal beam is designed as cable duct comprising a longitudinal slot arranged on one horizontal side.

14. Office desk according to claim 12, characterized in that the columns exhibit an elongated cross-section in a plane transverse to the longitudinal beam and comprise, at least on the side facing the longitudinal beam, two parallel rows of equally spaced longitudinal slots which are engaged by the hooks arranged at the ends of the longitudinal beam.

15. Office desk according to claim 14, characterized in that a bolt mounted for displacement in the longitudinal direction of the longitudinal beam is provided next to at least one of the hooks, which bolt engages the same longitudinal slot of the column as the hook itself, but at a point above the latter.

16. Office desk according to claim 15, characterized in that the hooks and the bolts are mounted on an insert fitted in the ends of a hollow profile forming the longitudinal beam.

17. Office desk according to claim 16, characterized in that the insert is mounted to slide within the hollow section of the longitudinal beam and can be displaced by means of an eccentric towards the interior of the hollow section whereby the end of the longitudinal beam can be clamped against the column.

18. Office desk according to claim 17, characterized in that the eccentric is formed by a rod seated transversely in the insert for eccentrical rotation, the said rod being in engagement with stops provided in the hollow section.

19. Office desk according to claim 14, characterized in that each column is made up from two parallel, hollow posts of substantially rectangular cross-section, each of the two parallel posts carrying a U rail having a U-shaped cross-section with the legs of the U-shape projecting toward the other of the two parallel posts and being provided with said longitudinal slots, and from a center web connecting the parallel, hollow posts and provided with U-shaped sections embracing the respective U rails.

20. Office desk according to claim 19, characterized in that the center web consists of two symmetrically shaped and disposed sheet-steel sections defining the U sections embracing the U rails.

21. Office desk according to claim 1, characterized in that the table top rests on the carrying arms and is connected wtih the carrying arms by means of latch means connected to the bottom face of the table top and engaging recesses in the carrying arms.

22. Office desk according to claim 21, charcterized in that the latch means includes locking bolts pivoted on a supporting frame arranged at the bottom face of the table top and fitting between the carrying arms, and when pivoted into locking position the ends of the bolts engage recesses in adjacent sides of the carrying arms so that the position of the table top relative to the table frame and in particular the longitudinal beam is defined by coaction with one flank each of the recesses.

23. Office desk according to claim 1, characterized in that at least one of the side parts is extended beyond the height of the table top by means of an adapted extension piece and that the extension piece is provided with mounting means for additional accessories, including carrying arms for additional table top elements.

24. Office desk according to claim 1, characterized in that at least one of the columns is provided, on its outside facing away from the longitudinal beam, with at least one carrying arm, preferably designed in the form of a shorter longitudinal beam, for receiving additional accessories, including an additional table top element.

* * * * *